US011530816B2

(12) United States Patent
Bertelli

(10) Patent No.: US 11,530,816 B2
(45) Date of Patent: Dec. 20, 2022

(54) DEVICE FOR CONTROLLING A MIXTURE IN A PREMIX GAS BURNER

(71) Applicant: BERTELLI & PARTNERS S.R.L., Angiari (IT)

(72) Inventor: Pierluigi Bertelli, Bardolino (IT)

(73) Assignee: BERTELLI & PARTNERS S.R.L, Verona (IT)

( * ) Notice: Subject to any disclaimer, the term of this patent is extended or adjusted under 35 U.S.C. 154(b) by 344 days.

(21) Appl. No.: 16/681,205

(22) Filed: Nov. 12, 2019

(65) Prior Publication Data

US 2020/0173659 A1 Jun. 4, 2020

(30) Foreign Application Priority Data

Nov. 30, 2018 (IT) ..... 102018000010736

(51) Int. Cl.
*F23D 14/02* (2006.01)
*F23N 1/02* (2006.01)
*F23N 5/18* (2006.01)

(52) U.S. Cl.
CPC ..... *F23N 1/025* (2013.01); *F23D 14/02* (2013.01); *F23N 5/18* (2013.01); *F23N 2225/06* (2020.01);
(Continued)

(58) Field of Classification Search
CPC . F23D 14/02; F23N 1/025; F23N 5/18; F23N 2235/00; F23N 2225/06; F23N 2233/08
(Continued)

(56) References Cited

U.S. PATENT DOCUMENTS 2,181,261 A * 11/1939 Breese ..... F23D 5/00 431/340
2,458,916 A * 1/1949 Gustave ..... F23D 5/00 431/336
(Continued)

FOREIGN PATENT DOCUMENTS

CA 2371188 A1 12/2000
DE 19635974 A1 3/1998
(Continued)

OTHER PUBLICATIONS

Italian Search Report corresponding to Italian patent application No. 102018000010736 dated Jul. 18, 2019, 7 pages.
(Continued)

*Primary Examiner* — Avinash A Savani
(74) *Attorney, Agent, or Firm* — Wentsler LLC

(57) ABSTRACT

A device for controlling a fuel-oxidizer mixture for a premix gas burner, comprises: an intake duct for admitting the mixture into the burner; an injection duct, connected to the intake duct to supply the fuel; a monitoring device for checking the state of combustion in the burner; a gas regulating valve; a fan located in the intake duct; a control unit for controlling the speed of rotation of the fan between a first and a second rotation speed, corresponding to a minimum flow rate of oxidizer (Qmin) and a maximum flow rate of oxidizer (Qmax), respectively; a regulator coupled to the intake duct and having a first aperture, adjustable through a first shutter, and a second aperture, adjustable through a second shutter. The control unit is configured to drive the gas regulating valve in real time.

16 Claims, 8 Drawing Sheets

(52) U.S. Cl.
CPC ..... *F23N 2233/08* (2020.01); *F23N 2235/00* (2020.01)

(58) Field of Classification Search
USPC ..... 431/12, 336, 340
See application file for complete search history.

(56) References Cited

U.S. PATENT DOCUMENTS

| | | | | |
|---|---|---|---|---|
| 3,161,025 | A * | 12/1964 | Fleckenstein | F15B 21/00 60/412 |
| 3,199,848 | A * | 8/1965 | Harrison | F24H 9/2064 432/49 |
| 3,229,748 | A * | 1/1966 | Spielman | F23C 7/008 431/352 |
| 4,424,793 | A * | 1/1984 | Cooperrider | F23D 14/36 126/110 B |
| 6,312,250 | B1 * | 11/2001 | Neville | F23D 14/60 431/1 |
| 6,604,938 | B1 | 8/2003 | Blaauwwiekel et al. | |
| 2003/0054308 | A1 * | 3/2003 | Abbasi | F23D 14/22 431/187 |
| 2009/0111065 | A1 * | 4/2009 | Tompkins | F23N 1/022 431/12 |
| 2013/0224670 | A1 | 8/2013 | Zatti et al. | |
| 2015/0159863 | A1 * | 6/2015 | Sievers | F23G 7/06 431/12 |
| 2015/0345784 | A1 | 12/2015 | Lee et al. | |
| 2016/0341439 | A1 * | 11/2016 | Karamanos | G05D 7/0635 |

FOREIGN PATENT DOCUMENTS

| | | |
|---|---|---|
| EP | 2660515 | 6/2013 |
| EP | 2918912 A2 | 9/2015 |
| WO | 2009133451 | 11/2009 |
| WO | 2011117896 | 9/2011 |

OTHER PUBLICATIONS

Search report dated May 7, 2020, issued by the Eurasian Patent Office in corresponding Eurasian application No. 201992428.

* cited by examiner

DEVICE FOR CONTROLLING A MIXTURE IN A PREMIX GAS BURNER

This invention relates to a device for controlling the mixture and a method for controlling the mixture in the context of premix gas burners.

In a premix gas burner, it is necessary to regulate the thermal power of the burner. The thermal power is regulated by varying the speed of rotation of a fan which supplies the oxidizer. For optimum combustion, therefore, it is essential to regulate the flow rate of the gas in such a way that the fuel-oxidizer ratio remains in an optimum range for combustion.

It is also very important to be able to maintain high working pressure in the intake duct for low thermal power, in order to avoid possible malfunctioning and loss of comfort, and low working pressure for high thermal power in order to generally save energy.

In the prior art, solutions for regulating fuel flow rate are known in which the intake duct is provided with a Venturi tube whose geometric characteristics are such as to produce, between the sections upstream and downstream of the Venturi tube, a pressure loss which is directly dependent on the fluid flow rate in the intake duct. This pressure loss is transmitted to a gas regulating valve, which opens or closes a gas injection section as a function of the pressure loss.

In such solutions, described, for example, in documents US2013224670A1 and CA2371188A1, the intake duct has a fixed geometry and the pressure losses are proportional to the square of the flow rate of the oxidizer. They do not therefore allow obtaining high working pressures for low thermal flows and cannot limit dissipation for high thermal flows.

Moreover, in the field of premix gas burners, it is becoming increasingly common for combustion heating appliances (for example, gas combustion appliances) to have, downstream of the combustion chamber, an exhaust manifold that is in common with others. Since the burners can be driven independently, the exhaust fumes of one burner might find their way into the intake duct of burners which are, at that moment, switched off, preventing them from being switched on in future and flowing back into the combustion chamber or into the room where the appliance is installed, depending on how the appliance is structured.

To overcome this problem, prior art solutions are known which implement dedicated non return valves mounted downstream of the combustion chamber.

There is, however, a now established need to reduce the number of parts in order to reduce the production costs of the control device under equal conditions of functions performed by the control device.

This invention has for an aim to provide a device for controlling the mixture and a method for controlling the mixture to overcome the above mentioned disadvantages of the prior art.

This aim is fully achieved, according to this disclosure, by the device for controlling the mixture and the method for controlling the mixture as characterized in the appended claims.

In an embodiment, this disclosure provides a device for controlling a fuel-oxidizer mixture for a premix gas burner. The device comprises an intake duct. The intake duct defines a cross section through which a fluid is admitted into the intake duct. The intake duct includes an inlet for receiving the oxidizer. The intake duct includes a mixing zone for receiving the fuel and allowing it to be mixed with the oxidizer. The intake duct includes a delivery outlet for delivering the mixture to the burner. The intake duct is configured to convey the mixture in a direction of inflow oriented from the inlet to the delivery outlet.

In an embodiment, the device comprises an injection duct. The injection duct is connected to the intake duct in the mixing zone to supply the fuel. The injection duct may be located upstream or downstream of the fan and upstream or downstream of the regulator.

In an embodiment, the device comprises a monitoring device. The monitoring device is configured to generate a control signal. In an embodiment, the control signal represents a state of combustion in the burner. In other embodiments, the control signal may represent other parameters which are known to those skilled in the art and which can be used to monitor the operation of the burner.

In an embodiment, the device comprises a gas regulating valve. The gas regulating valve is located along the injection duct.

In an embodiment, the device comprises a fan which rotates at a speed of rotation. In an embodiment, the speed of rotation of the fan is variable between a first rotation speed, corresponding to a minimum flow rate of oxidizer, and a second rotation speed, corresponding to a maximum flow rate of oxidizer. The fan is located in the intake duct to generate therein a flow of oxidizer in a direction of inflow oriented from the inlet to the delivery outlet.

In an embodiment, the mixing zone is located upstream of the fan, along the intake duct in the direction of inflow. That way, the negative pressure generated by the fan facilitates gas intake even when the mains pressure (pressure of the gas distribution line) decreases.

In an embodiment, the device comprises a control unit. The control unit is configured to control the speed of rotation of the fan between the first rotation speed and a second rotation speed.

In an embodiment, the device comprises a regulator. The regulator is coupled to the intake duct to vary its cross section. The regulator is coupled to the intake duct to vary its cross section as a function of the speed of rotation of the fan.

In an embodiment, the regulator includes a first aperture for defining a first working cross section. By working cross section is meant a cross section through which the oxidizer can flow through the regulator.

In an embodiment, the regulator includes a first shutter. The first shutter is movable between a closed position, where the first aperture is fully closed, and an open position, where the first aperture is at least partly open, to vary the first working cross section. In an embodiment, the open position is a limit position which defines a maximum value of the first working cross section even if the first aperture is only partly open.

In an embodiment, the first shutter is movable under the effect of a pressure difference created in the intake duct by the rotation of the fan. More specifically, the fan is configured to create a pressure head such that the oxidizer upstream of the first shutter has a certain pressure. The shutter includes a constriction which causes a pressure loss. The oxidizer downstream of the first shutter therefore has a downstream pressure that is lower than the upstream pressure. This pressure difference between the position downstream and the position upstream of the first shutter causes a displacement of the first shutter.

In an embodiment, the regulator includes a second aperture for defining a second working cross section.

In an embodiment, the regulator includes a second shutter. The second shutter is movable between a closed position, where the second aperture is fully closed, and an open position, where the second aperture is at least partly open, to vary the second working cross section.

In an embodiment, the second shutter is movable under the effect of a pressure difference created in the intake duct by the rotation of the fan. More specifically, the fan is configured to create a pressure head such that the oxidizer upstream of the second shutter has a certain pressure. The shutter includes a constriction which causes a pressure loss. The oxidizer downstream of the second shutter therefore has a downstream pressure that is lower than the upstream pressure. This pressure difference between the position downstream and the position upstream of the second shutter causes a displacement of the second shutter.

In other embodiments, the displacements of the first and second shutters are electronically controlled by the control unit.

In an embodiment, the control unit is configured to receive the control signal. The control unit is configured to generate a drive signal as a function of the control signal. In an embodiment, the drive signal represents a flow rate of the fuel. Generating the drive signals allows driving the gas regulating valve in real time.

That way, regulating the gas is made independent of the geometry of the intake duct, making it possible to vary the geometry without negatively affecting gas control.

In an embodiment, the first shutter is configured to be positioned at the open position when the rotation speed of the fan is higher than the first rotation speed. More specifically, in an embodiment, when the oxidizer is at its minimum flow rate, the first shutter is at the open position.

That way, when the oxidizer is at its minimum flow rate (hence at the minimum thermal flow), the regulator defines a first maximum working cross section, no longer variable, which allows rapidly increasing the working pressure for minimum oxidizer flow rates.

This feature is very important to reduce the sensitivity of the boiler to external events, which might cause it to switch off, resulting in loss of comfort and/or non-permissible deviations of the minimum flow rate values. In effect, heat generator certification standards, for example, set limitations on the amount of the deviation (5% of the declared minimum flow) from the guaranteed minimum flow in response to discharge pressure variations. Reference is made in particular to the standards EN 15502-2-1:2012 and A1-2016-UNI-2017. Without the solution described in this disclosure, it would in fact be necessary to reduce the working range of the boiler, thus reducing its flexibility.

In an embodiment, the regulator is located upstream of the fan, along the intake duct.

In an embodiment, the first shutter, at the open position, is disposed at a limit position so that the open position it defines corresponds to a maximum value obtainable by the first shutter for the first working cross section.

In an embodiment, the second shutter is configured to be positioned at the closed position when the rotation speed of the fan is lower than a cut-out speed, which is higher than the first rotation speed and lower than the second rotation speed. That way, the second regulator reduces the maximum working pressure, reducing energy consumption and the costs connected therewith.

These features allow the regulator to perform the function of partialization and the function of non-return valve simultaneously.

In an embodiment, the first shutter is connected to the second shutter. This connection simplifies the production of the two shutters and allows designing a motion of the first shutter due to the movement of the second shutter.

In an embodiment, the first shutter is smaller in mass than the second shutter. In an embodiment, the first shutter is smaller in mass than the second shutter according to a ratio of between 1:3 and 1:60. Preferably, the ratio between the two masses is between 1:3 and 1:40. In an embodiment, the ratio between the two masses is 1:35. In other embodiments, the ratio between the two masses is between 1:25 and 1:35.

That way, the first and the second shutter move over very different working ranges.

In an embodiment, the weight of the second shutter is determined as a function of the cut-out speed of the second shutter. In effect, in this embodiment, the moment the second shutter starts moving corresponds to the moment the pressure difference applied to the second shutter exceeds the weight of the second shutter.

In other embodiments, the second shutter is held at the closed position by an elastic element. In such an embodiment, the elastic properties of the elastic element are determined as a function of the cut-out speed of the second shutter.

In an embodiment, the second shutter comprises a cavity. In an embodiment, the second shutter comprises a first calibration element. The first calibration element is housed in the cavity. The first calibration element can be replaced with a second calibration element differing in mass from the first calibration element in order to vary the cut-out speed.

In other embodiments, the elastic element can be replaced by another elastic element having different elastic properties in order to vary the cut-out speed These features allow enhancing the flexibility of the device in that its cut-out speed can be varied as a function of specific design constraints.

In an embodiment, the first shutter comprises a first door. The first door is positioned downstream of the first aperture in the direction of inflow. The first door is rotatable about a first pivot to move from the closed position to the open position.

In an embodiment, the second shutter comprises a second door. The second door is positioned downstream of the second aperture in the direction of inflow. The second door is rotatable about a second pivot.

Advantageously, in an embodiment, the first pivot is defined by a portion of the first door that is more flexible than the other portions of the first door. Thus, no additional elements are needed to allow rotation of the door and constructional simplicity is increased.

In an embodiment, the regulator comprises an opposing element. The opposing element is connected to the first shutter. The opposing element is configured to generate a force whose direction is opposite to the opening direction of the first shutter so as to ensure that the first shutter is closed when the rotation speed of the fan is lower than the first rotation speed. In an embodiment, the opposing element may be a return spring. In an embodiment, the opposing element may be a protrusion that keeps the first shutter at the open position at an opening angle of less than ninety degrees.

In an embodiment, the regulator has the shape of a disc. That way, it can be mounted directly on the intake duct. In an embodiment, the regulator comprises a wall.

In an embodiment, the wall is perpendicular to the direction of flow of the oxidizer. In an embodiment, the first and second apertures are formed on this wall.

In an embodiment, the regulator comprises a plastic element. The plastic element is coupled to the wall. The plastic element includes the first and the second shutter. In an embodiment, the plastic element is a sheath surrounding the wall. In other embodiments, the first and second shutters are hinged directly to the wall.

In an embodiment, the wall includes a fastening zone. The fastening zone is configured to be connected at a delivery outlet of the fan. The fastening zone comprises a plurality of holes that accommodate connectors configured to be inserted therein at the delivery outlet of the fan.

In an embodiment, the regulator comprises a first mouth.

In an embodiment, the regulator comprises a second mouth. The first mouth is located upstream of the first aperture in the direction of inflow in order to convey the flow of oxidizer into the first aperture. The second mouth is located upstream of the second aperture in the direction of inflow in order to convey the flow of oxidizer into the second aperture. In an embodiment, the first and/or the second mouth have profiles that are convergent in the direction of inflow.

In an embodiment, the convergence of the first mouth is greater than that of the second mouth so as to accelerate to a greater extent the oxidizer directed towards the first aperture. That way, the thrust of the fluid at low flows operates more on the first shutter, facilitating the rapid opening thereof.

In an embodiment, the first actuator comprises a first sealing element. The first sealing element is configured to prevent fluid from flowing in a return direction, opposite to the direction of inflow. More specifically, in an embodiment, the first sealing element is a plastic element which, when subjected to the pressure of a fluid in the return direction is squeezed against the wall to create the fluid seal.

In an embodiment, the second actuator comprises a second sealing element. The second sealing element is configured to prevent fluid from flowing in a return direction, opposite to the direction of inflow. More specifically, in an embodiment, the second sealing element is a plastic element which, when subjected to the pressure of a fluid in the return direction is squeezed against the wall to create the fluid seal.

In an embodiment, the regulator is located downstream of the fan and upstream of the combustion chamber along the intake duct.

In an embodiment, the regulator is located upstream of the fan and upstream of the mixing zone along the intake duct.

In an embodiment, the regulator is located upstream of the fan and downstream of the mixing zone along the intake duct.

In an embodiment, the regulator is located downstream of the fan and upstream of the mixing zone along the intake duct.

In an embodiment, the regulator is located downstream of the fan and downstream of the mixing zone along the intake duct. It should be noted that with variation of the relative position between the regulator and the mixing zone (which, as mentioned above, differs according to the embodiment adopted), the regulator is traversed only by the oxidizer or by the oxidizer and the fuel already mixed together. In this disclosure, therefore, reference to the flow of oxidizer through the regulator means a flow of oxidizer or a flow of fuel-oxidizer mixture, depending on the embodiment adopted.

In an embodiment, the control device comprises a non-return valve. The non-return valve is configured to prevent the return of exhaust fumes from burners, if any, that share the exhaust duct. In an embodiment, the non-return valve is a vane, connected by a respective hinge and configured to be closed when subjected to a pressure directed from the exhaust duct to the intake duct.

In an embodiment, the non-return valve is redundant with respect to the first shutter to create a seal if the first shutter is damaged. In other embodiments, the device is without the first shutter and the non-return function is performed by the non-return valve, which is distinct from the regulator. In such an embodiment, the regulator is a partializer, configured to partialize the fuel-oxidizer mixture.

In an embodiment, the working cross section of the regulator is inclined at a working angle to a plane perpendicular to the weight force. In an embodiment, a working cross section of the non-return valve is inclined at a working angle to a plane perpendicular to the weight force.

In an embodiment, the first pivot of the first shutter is located at a higher level than the first door of the first shutter.

In an embodiment, the second pivot of the second shutter is located at a higher level than the second door of the second shutter.

In an embodiment, the hinge of the non-return valve is located at a higher level than the valve plate.

In an embodiment, the working angle is between 15 and 60 degrees. In an embodiment, the working angle is between 15 and 40 degrees. In an embodiment, the working angle is between 40 and 60 degrees. In an embodiment, the working angle is between 60 and 90 degrees.

This regulator and non-return valve assembly prevents problems due to hysteresis of the first and/or of the second door of the regulator and/or of the non-return valve plate. This regulator and non-return valve assembly prevents problems due to "snapping" or "flickering" of the first and/or of the second door of the regulator and/or of the non-return valve plate.

In an embodiment, the intake duct comprises an inflow duct, connected to the combustion chamber to convey the mixture therein. The inflow duct may comprise a plurality of valves, configured to regulate (or interrupt) the flow of mixture (in the event of an emergency, for example).

In an embodiment, the control device comprises a flow sensor. The flow sensor is located downstream of the regulator and upstream of the combustion chamber along the intake duct. The flow sensor is configured to measure the flow rate of the mixture in the intake duct.

In an embodiment, the flow sensor is configured to send flow signals, representing the flow rate of the mixture in the intake duct, to the control unit.

In an embodiment, the control unit is configured to drive the fan through drive signals determined as a function of the flow signals received from the flow sensor.

In an embodiment, the control unit is configured to receive reference data.

In an embodiment, the reference data represent an ideal behaviour of the regulator of the device. In an embodiment, the reference data may comprise a first characteristic curve, in which each rotation speed of the fan, between the first and the second rotation speed, corresponds to a flow rate value of the mixture. In an embodiment, the reference data may comprise a second characteristic curve, in which each absorbed power value of the fan corresponds to a flow rate value of the mixture. In an embodiment, the reference data may comprise a third characteristic curve, in which each absorbed power value corresponds to a working pressure value.

In an embodiment, the control unit is configured to compare the flow signals with the reference data. In an embodiment, the control unit is configured to identify a malfunction of the regulator based on the comparison between the flow signals and the reference data.

In an embodiment, the control unit is configured to measure, directly or indirectly, the real working power of the fan for each working pressure. In an embodiment, the control unit is configured to compare the real working power with an ideal working power determined for each working pressure from a first characteristic curve. In an embodiment, the control unit is configured to generate comparative data, representing a deviation between real working power and ideal working power. In an embodiment, the control unit is configured to perform a diagnosis of the device as a function of the comparative data to determine, for example, but not only, whether there are any problems due to incorrectly fastened or broken components.

In an embodiment, the control unit is configured to perform a periodic test procedure at predetermined intervals. In the periodic test procedure, the control unit is configured to progressively reduce the speed of the fan to a predetermined minimum value starting from a condition in which the burner is on and functioning. The control unit is configured to check whether the system is shut down at a predetermined speed level (the flame signal drops below a predetermined minimum threshold) on account of correct closure of the first and the second shutter. In such a case, the control unit is configured to detect that the device is functioning correctly.

The control unit is configured to check whether the system remains on at a predetermined speed level. In such a case, the control unit is configured to detect that the functioning of the device is faulty.

In an embodiment, the mixture control device comprises a mixer. The mixer is configured to facilitate mixing the oxidizer and the fuel together where the hydraulic properties (fluid speed, motion regime) are not sufficient to ensure correct mixing.

In an embodiment, the control device includes a pneumatic gas valve regulating system. More specifically, as is known from the prior art, the pneumatic regulating system detects the pressure differences between an upstream and a downstream section of a Venturi in the intake duct. The gas valve is regulated as a function of the pressure difference. A more exhaustive description of the pneumatic gas valve regulating system can be found in document WO2009133451A2, which is incorporated herein by reference.

Hereinafter, for brevity, the term "electronic control" is used to denote controlling by sending drive signals proportional to the control signals and the term "pneumatic control" to denote controlling performed as a function of the pressure difference between the pressure upstream and the pressure downstream of the Venturi.

In an embodiment, the regulator comprises only the second shutter. In this embodiment, the regulator may also be identified as an air partializer. Hereinafter, therefore, to distinguish it from the regulator (which also performs a non-return function) we will use the term "partializer" to denote a regulator whose function is only that of partializing the mixture.

In an embodiment, the mixture control device comprises:

the mass flow sensor, configured to measure the flow rate of the mixture flowing in the intake duct;

the regulator, configured to partialize the air and to prevent exhaust fume return;

the electrically (electronically) controlled gas valve.

In an embodiment, the mixture control device comprises:

the mass flow sensor, configured to measure the flow rate of the mixture flowing in the intake duct;

the regulator, configured to partialize the air and to prevent exhaust fume return;

the pneumatically controlled gas valve;

the mixer, located upstream of the fan to mix the fuel and the oxidizer. The mixer increases the mixing efficiency but is not essential for this embodiment.

In an embodiment, the mixture control device comprises:

the mass flow sensor, configured to measure the flow rate of the mixture flowing in the intake duct;

the partializer, configured to partialize the fuel-oxidizer mixture;

the non-return valve, configured to prevent exhaust fume return;

the electrically (electronically) controlled gas valve.

In an embodiment, the mixture control device comprises:

the mass flow sensor, configured to measure the flow rate of the mixture flowing in the intake duct;

the partializer, configured to partialize the fuel-oxidizer mixture;

the non-return valve, configured to prevent exhaust fume return;

the pneumatically controlled gas valve;

the mixer, located upstream of the fan to mix the fuel and the oxidizer. The mixer increases the mixing efficiency but is not essential for this embodiment.

According to an aspect of it, this disclosure intends protecting a fan for supplying oxidizer or a fuel-oxidizer mixture to a premix gas burner, comprising:

an outer container;

a rotary element, including a plurality of blades, configured to push a flow of fuel-oxidizer mixture or a flow of oxidizer in a supply direction;

an actuator, configured to drive the rotary element, characterized in that it comprises a regulator, coupled to the intake duct to vary its cross section as a function of the speed of rotation of the fan.

It should be noted that the regulator included in the fan to be protected may include one or more of the features described in this disclosure which, for brevity, will not all be reproduced in the version of the fan included in the fan.

According to one aspect of it, this disclosure provides a heat generator including one or more of the following features:

a combustion head, configured to burn a fuel-oxidizer mixture;

an intake duct, extending from an inlet to a delivery outlet and configured to convey the fuel-oxidizer mixture into the combustion chamber;

a fan, connected to the intake duct and rotating to produce a forced circulation of the fuel-oxidizer mixture inside the intake duct in a direction oriented from the inlet to the delivery outlet;

a first heating circuit, including a duct passing through the combustion chamber to allow heating the fluid flowing inside it;

a second heating circuit and a heat exchanger, configured to allow exchanging heat between the first heating circuit and the second heating circuit.

an injection duct, connected to the intake duct in a mixing zone, to supply the fuel;

a monitoring device configured to generate a control signal representing a state of combustion in the combustion head;

a gas regulating valve, located along the injection duct;

a control unit, configured to control the speed of rotation of the fan between a first rotation speed, corresponding to a minimum flow rate of oxidizer, and a second rotation speed, corresponding to a maximum flow rate of oxidizer;

a regulator, coupled to the intake duct to vary its cross section as a function of the speed of rotation of the fan.

The regulator comprises one or more of the following features:

a first aperture, for defining a first working cross section;

a first shutter, movable under the effect of a pressure difference created in the intake duct by the rotation of the fan between a closed position, where the first aperture is fully closed, and an open position, where the first aperture is at least partly open, to vary the first working cross section;

a second aperture defining a second working cross section;

a second shutter, movable under the effect of a pressure difference created in the intake duct by the rotation of the fan, between a closed position, where the second aperture is fully closed, and an open position, where the second aperture is at least partly open, to vary the second working cross section as a function of the rotation speed of the fan.

In an embodiment, the control unit is configured to receive the control signal and to generate a drive signal representing a fuel flow rate as a function of the control signal in order to drive the gas regulating valve in real time.

It should be noted that, in an embodiment, the heat generator comprises the control device according to one or more of the features described in this disclosure. In an embodiment, the heat generator comprises the fan according to one or more of the features described in this disclosure.

The table below shows the different embodiments for the working cross sections of the first and second apertures. In particular, this disclosure intends protecting one or more of the following embodiments:

Ratio between second working cross section and first working cross section variable in a range between 12 and 26, preferably for working powers variable between 1.25 and 25 kW Ratio between second working cross section and first working cross section variable in a range between 10 and 22, preferably for working powers variable between 1.25 and 25 kW Ratio between second working cross section and first working cross section variable in a range between 7 and 14, preferably for working powers variable between 1.25 and 25 kW Ratio between second working cross section and first working cross section variable in a range between 9 and 18, preferably for working powers variable between 1.75 and 35 kW Ratio between second working cross section and first working cross section variable in a range between 7 and 15, preferably for working powers variable between 1.75 and 35 kW Ratio between second working cross section and first working cross section variable in a range between 5 and 10, preferably for working powers variable between 1.75 and 35 kW Ratio between second working cross section and first working cross section variable in a range between 9 and 26, preferably for working powers variable between 2.4 and 48 kW Ratio between second working cross section and first working cross section variable in a range between 8 and 22, preferably for working powers variable between 2.4 and 48 kW Ratio between second working cross section and first working cross section variable in a range between 5 and 15, preferably for working powers variable between 2.4 and 48 kW

| | $S1^{(1)}$ $mm^2$ | $S2^{(2)}$ $mm^2$ | S2/S1 |
|---|---|---|---|
| 25 kW/1.25 kW | 39 | 500/1300 | 12/26 |
| | 47 | | 10/22 |
| | 67 | | 7/14 |
| 35 kW/1.75 kW | 55 | 500/1300 | 9/18 |
| | 66 | | 7/15 |
| | 94 | | 5/10 |
| 48 kW/2.4 kW | 63 | 600/1600 | 9/26 |
| | 75 | | 8/22 |
| | 107 | | 5/15 |

In an embodiment, the regulator of this disclosure is configured to apply a fluid resistance on the oxidizer (or on the mixture). The fluid resistance represents the pressure loss which the fluid undergoes when it flows through the regulator. In particular, the fluid resistance can be calculated as follows:

$$R = \frac{\sqrt{\Delta P}}{Q}$$

In an embodiment, the regulator of this disclosure is configured to apply a very high fluid resistance for low thermal flows. More specifically, the device is configured to have, at low flows, a total fluid resistance approximately equal to the fluid resistance of the regulator. At high flows, the device is configured to have a total fluid resistance that is appreciably greater than the fluid resistance of the regulator.

The table below shows the values of the fluid resistance at the minimum power in a control device whose working range is between 1.75 kW and 35 kW. The fluid resistance values are a function of the working area and a function of a working pressure value.

| S1 mm2 | | R $\frac{\sqrt{Pa}}{l/s}$ |
|---|---|---|
| 35 kW/1.75 kW | 50 | 15 @150 Pa |
| | 70 | 10 @100 Pa |
| | 98 | 7.5 @50 Pa |

According to one aspect of it, this disclosure also provides a method for controlling the fuel-oxidizer mixture in a premix gas burner.

In an embodiment, the method comprises a step of admitting oxidizer into an intake duct through an inlet. The method comprises a step of delivering fuel-oxidizer mixture through a delivery outlet.

The method comprises a step of mixing oxidizer and fuel in a mixing zone. The method comprises a step of feeding fuel to the mixing zone through an injection duct connected to the intake duct.

The method comprises a step of monitoring the combustion in the burner and generating control signals through a monitoring device.

The method comprises a step of generating a drive signal through a control unit as a function of the control signals.

The method comprises a step of varying a fuel flow rate through a gas regulating valve located along the injection duct. The method comprises a step of operating a fan at a variable speed of rotation. The method comprises a step of generating a flow in the intake duct in a direction of inflow oriented from the inlet to the delivery outlet. In an embodiment of the method, in the step of operating the fan, the fan varies its speed of rotation in a working range between a first rotation speed, corresponding to a minimum flow rate of oxidizer, and a second rotation speed, corresponding to a maximum flow rate of oxidizer.

In an embodiment, the method comprises a step of varying a cross section which admits a fluid into the intake duct. In an embodiment, the step of varying the cross section of the intake duct is performed as a function of the fan rotation speed through a regulator coupled to the intake duct.

In an embodiment, the step of varying the cross section comprises a step of moving a first shutter of the regulator between a closed position, where the first aperture is fully closed, and an open position, where the first aperture is at least partly open, to vary a first working cross section of the regulator.

In an embodiment, the step of varying the cross section comprises a step of moving a second shutter of the regulator between a closed position, where a second aperture of the regulator is fully closed, and an open position, where the second aperture is at least partly open, to vary a second working cross section of the regulator. In an embodiment, the step of moving the second shutter is performed as a function of the rotation speed of the fan.

In an embodiment, in the step of varying the flow rate of the fuel, the control unit receives the control signal. The control unit generates the drive signal as a function of the control signal. In an embodiment, the drive signal represents a flow rate of the fuel to drive the gas regulating valve in real time.

In an embodiment, in the step of moving, the first shutter is at the open position when the rotation speed of the fan is greater than or equal to the first rotation speed. More specifically, the first shutter moves when the speed is less than or equal to the first rotation speed.

In an embodiment, the second shutter is at the closed position when the rotation speed of the fan is lower than a cut-out speed, which is greater than or equal to the first rotation speed and less than or equal to the second rotation speed.

In an embodiment of the method, when the first actuator reaches the open position, the first working cross section reaches a maximum value, at which it remains constant in the working range included between the first and the second rotation speed.

In an embodiment, the method comprises a step of calibrating the second shutter. In the step of calibrating, the second shutter keeps in its cavity a first calibration element. In the step of calibrating, the first calibration element is replaced with a second calibration element having different physical properties. More specifically, in some embodiments, the second calibration element has a different mass than the first calibration element.

In an embodiment, the step of moving the first shutter comprises rotating about a first pivot. In an embodiment, the step of moving the second shutter comprises rotating about a second pivot.

In an embodiment, the method comprises a step of opposing, in which an opposing element of the regulator generates a force whose direction is opposite to an opening direction of the first shutter so as to ensure that the first shutter is closed when the rotation speed of the fan is lower than the first rotation speed.

In an embodiment, the method comprises a step of conveying. In the step of conveying, a first mouth, located upstream of the first aperture in the direction of inflow, conveys the flow of oxidizer into the first aperture. In the step of conveying, the first mouth accelerates the flow of oxidizer into the first aperture.

In the step of conveying, a second mouth, located upstream of the second aperture in the direction of inflow, conveys the flow of oxidizer into the second aperture. In the step of conveying, the second mouth accelerates the flow of oxidizer into the second aperture.

In an embodiment, the method comprises a step of receiving reference data representing an ideal behaviour of the regulator of the device. In an embodiment, the reference data may comprise a first characteristic curve, in which each rotation speed of the fan, between the first and the second rotation speed, corresponds to a flow rate value of the mixture, and/or a second characteristic curve, in which each absorbed power value of the fan corresponds to a flow rate value of the mixture, and/or a third characteristic curve, in which each absorbed power value corresponds to a working pressure value.

In an embodiment, the method comprises a step of comparing, in which the control unit compares the flow signals with the reference data. In an embodiment, the method comprises a step of identifying malfunctioning, in which the control unit identifies a malfunction of the regulator based on the comparison between the flow signals and the reference data.

In an embodiment, the method comprises a step of measuring, in which the control unit directly or indirectly measures the real working power of the fan for each working pressure. In an embodiment, in the step of comparing, the control unit compares the real working power with an ideal working power determined for each working pressure from the first and/or the second and/or the third characteristic curve.

In an embodiment, the method comprises a step of generating comparative data, in which the control unit generates comparative data, representing a deviation between real working power and ideal working power. In an embodiment, the method comprises a step of diagnosing, in which the control unit performs a diagnosis of the device as a function of the comparative data to determine, for example, but not only, whether there are any problems due to incorrectly fastened or broken components.

In an embodiment, the method comprises a step of periodic testing at predetermined intervals. The step of periodic testing comprises a step of reducing speed, in which the control unit progressively reduces the speed of the fan to a predetermined minimum value starting from a condition in which the burner is on and functioning. The step of periodic testing comprises a step of checking, in which the control unit checks whether the system is shut down at a predetermined speed level (the flame signal drops below a predetermined minimum threshold) on account of correct closure of the first and the second shutter. In such a case, the control unit detects that the device is functioning correctly.

In the step of checking, the control unit checks whether the system remains on at a predetermined speed level. In such a case, the control unit detects that the functioning of the device is faulty.

These and other features will become more apparent from the following detailed description of a preferred embodiment, illustrated by way of non-limiting example in the accompanying drawings, in which:

FIG. 1 schematically illustrates a mixture control device;

FIG. 1A schematically illustrates a detail of a regulator from FIG. 1;

Figures 1, 1A:
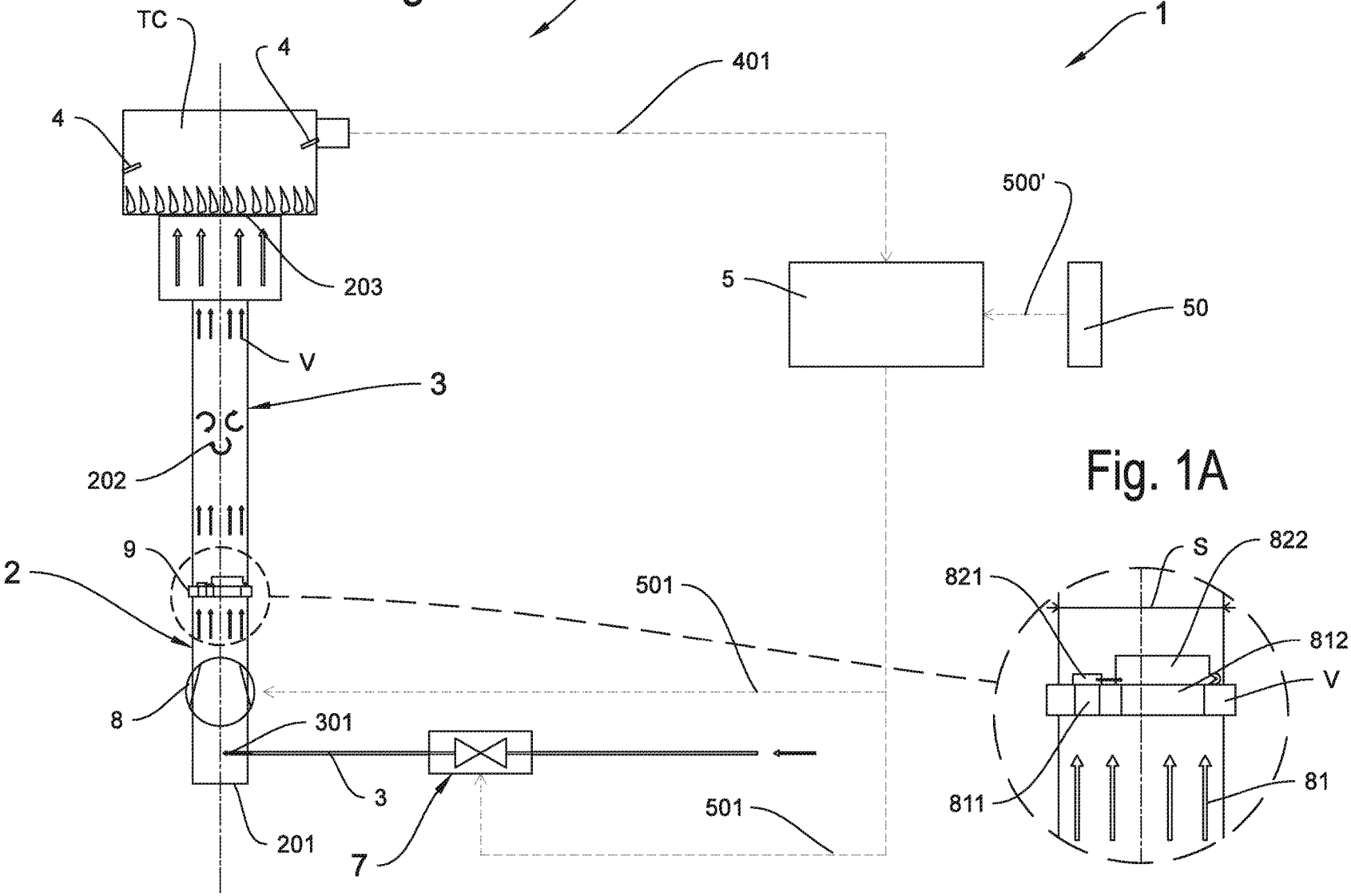
Figure 2B:
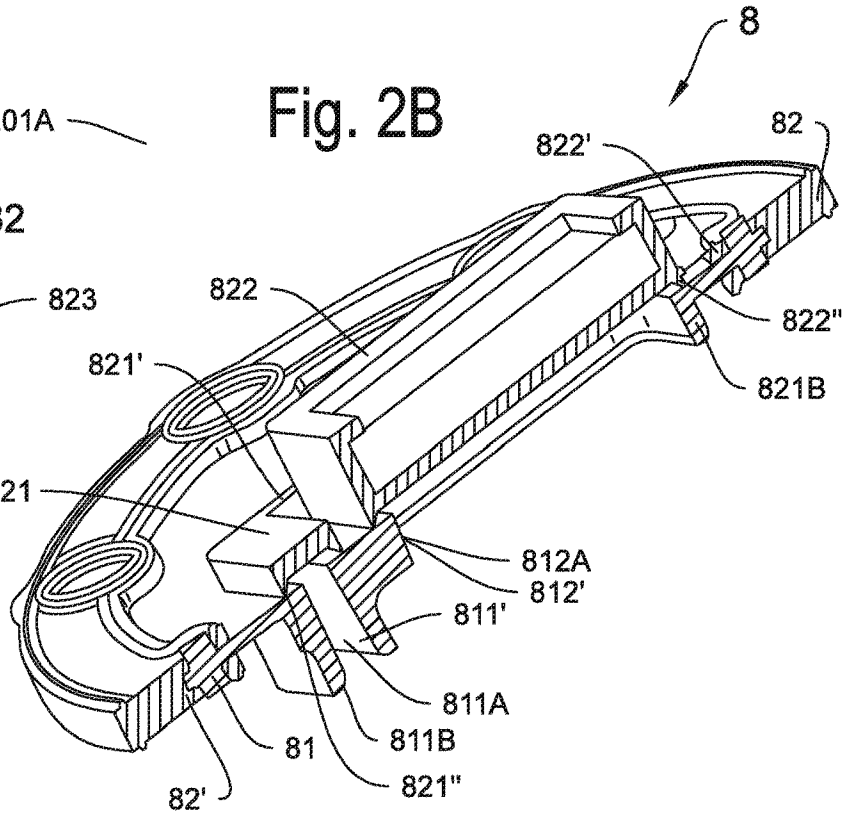
FIG. 2B shows a cross section of the perspective view of the regulator of FIG. 2A.
Figure 2A:
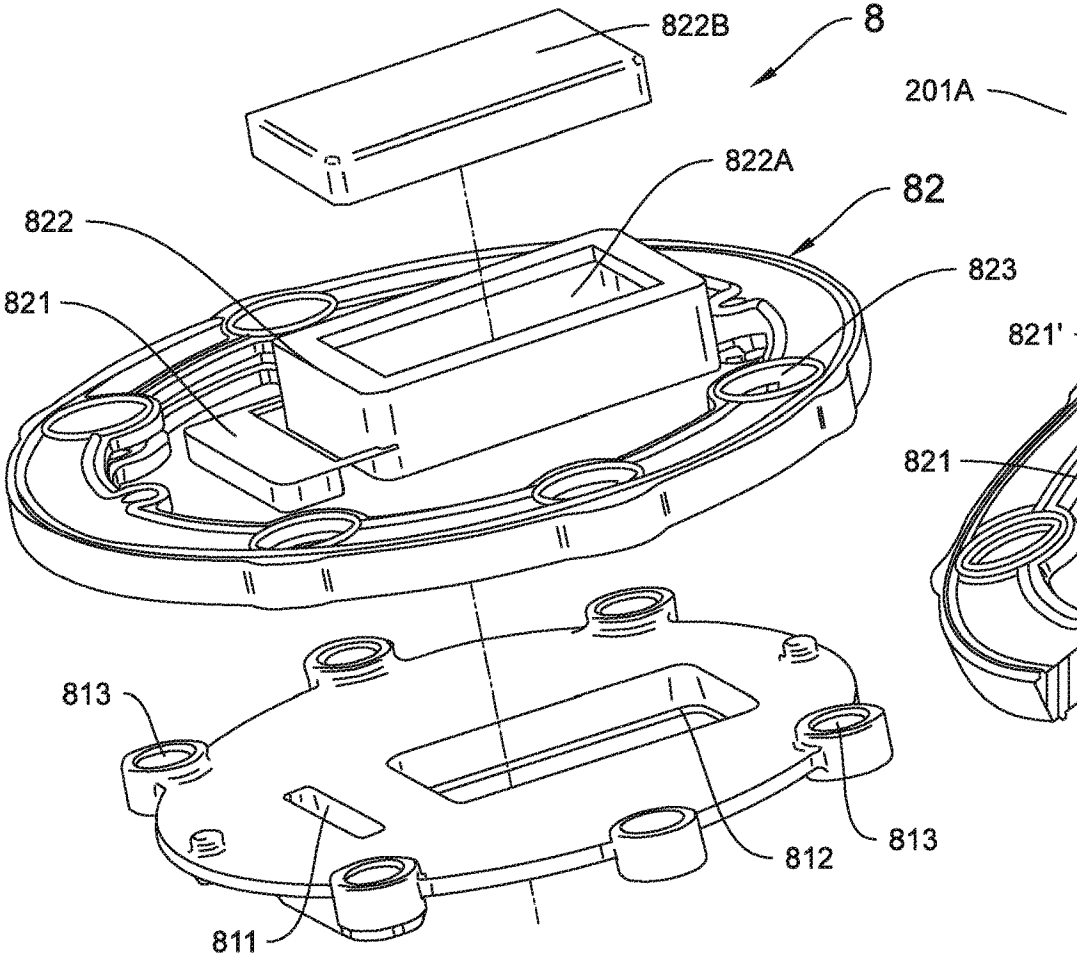
FIG. 2A shows an exploded perspective view of a regulator of the device of FIG. 1.
Figure 3B:
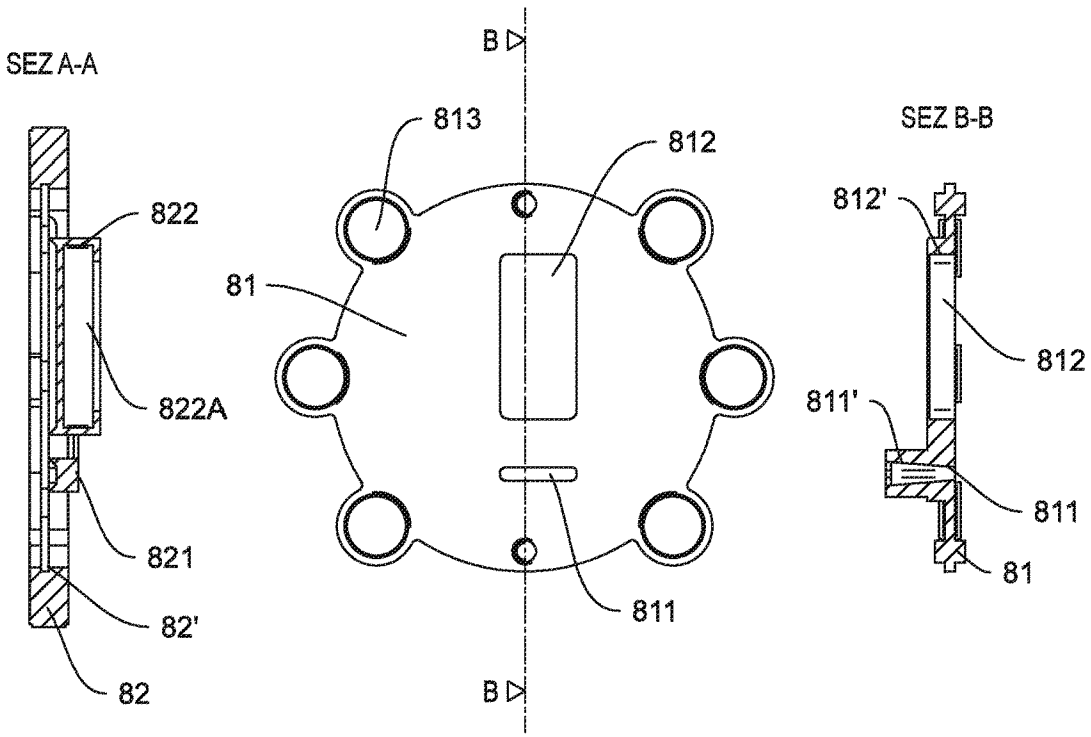
FIGS. 3A and 3B show a plan view and a cross section of a wall and a plastic element of the regulator of FIG. 2A, respectively.
Figure 3A:
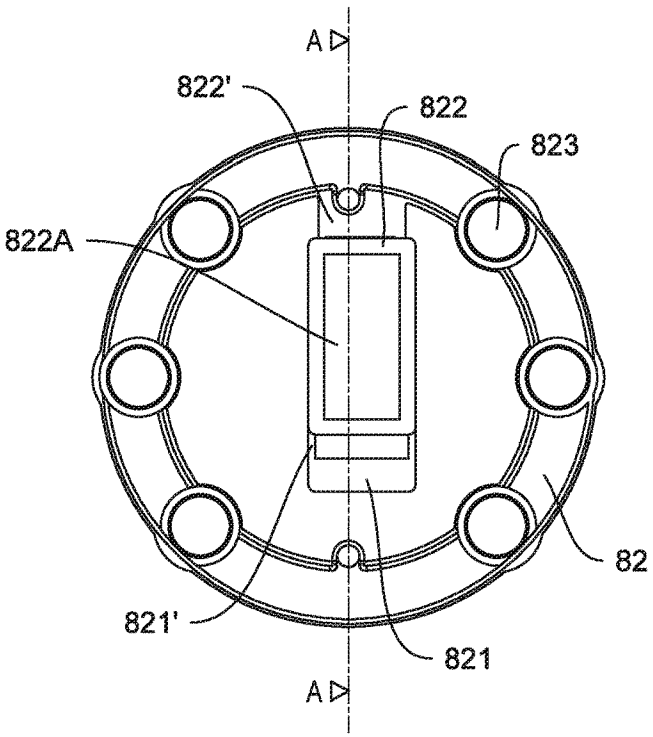
Figures 4A, 4B, 4C:
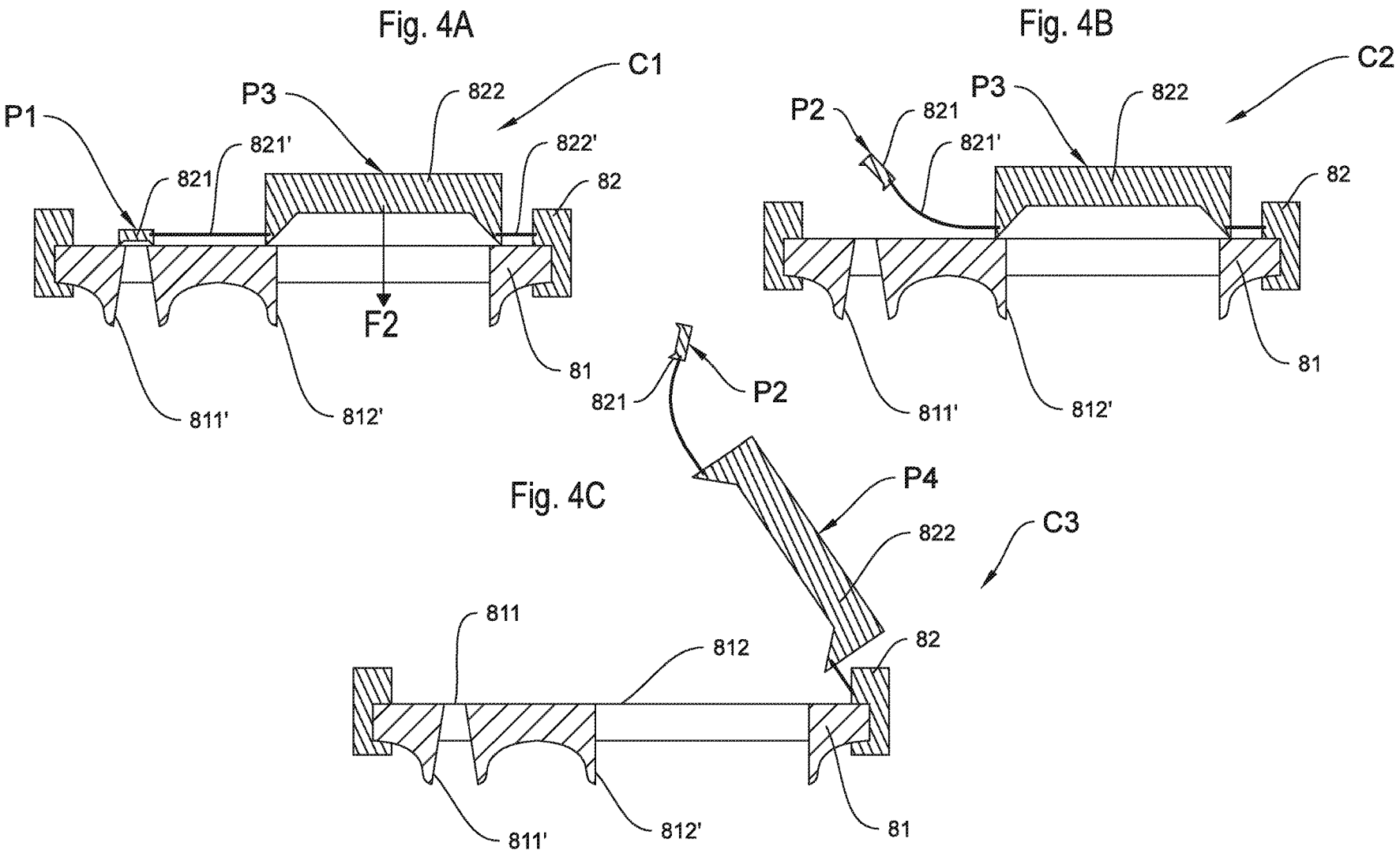
Figure 5:
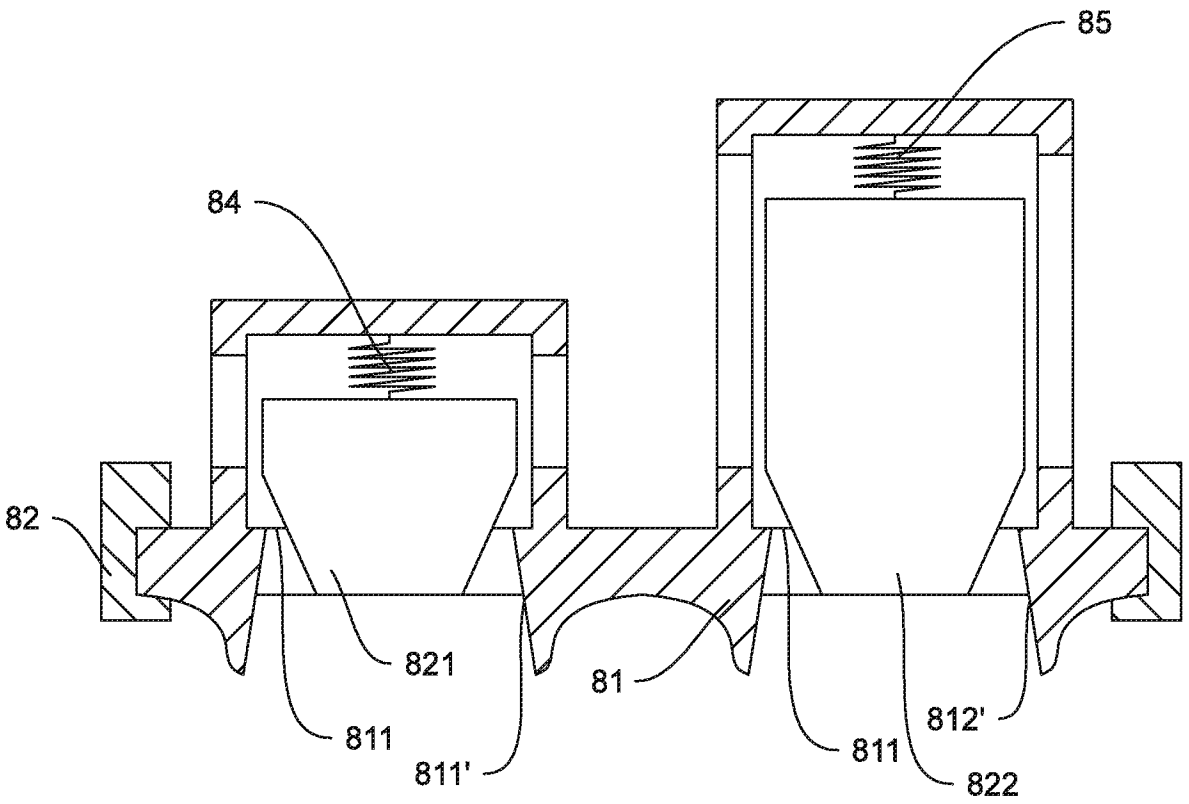
Figure 6B:
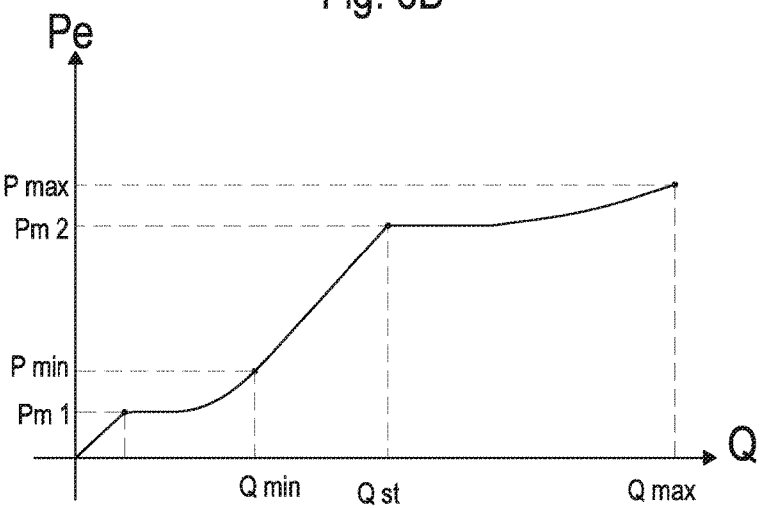
Figure 6C:
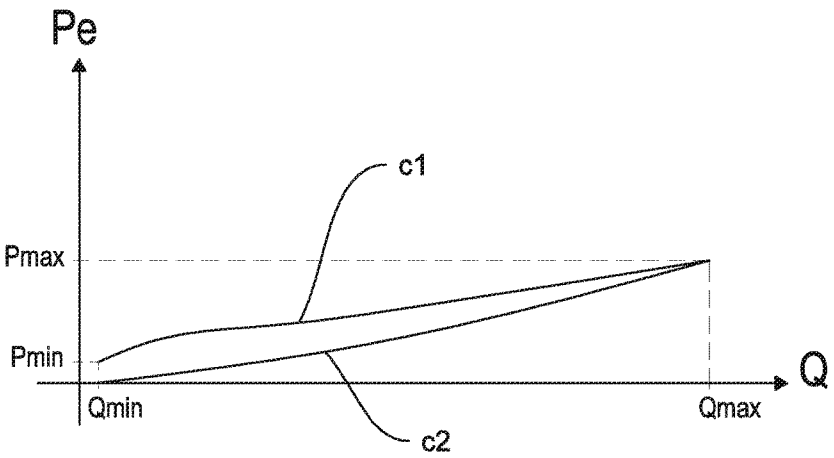
Figure 6A:
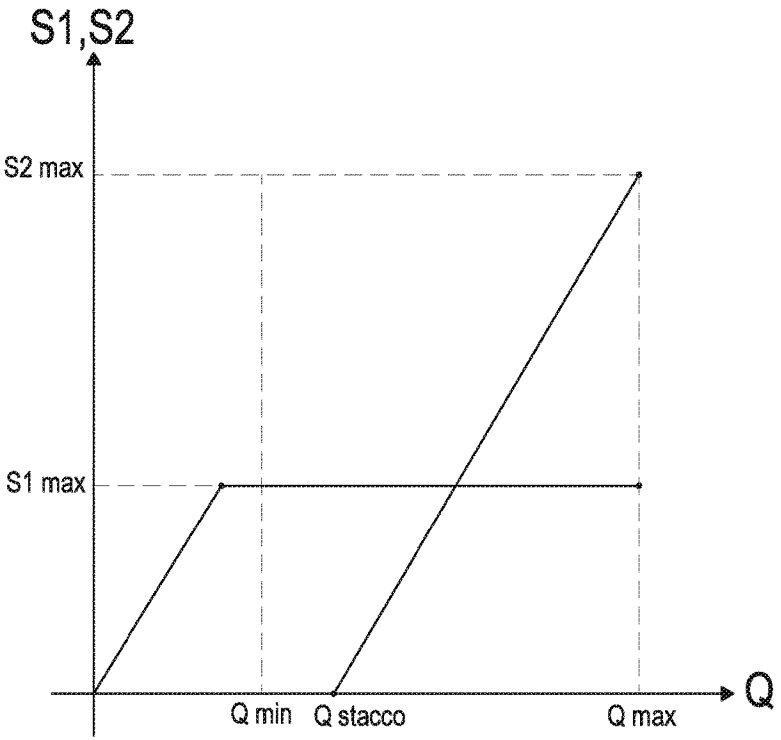
Figure 7A:
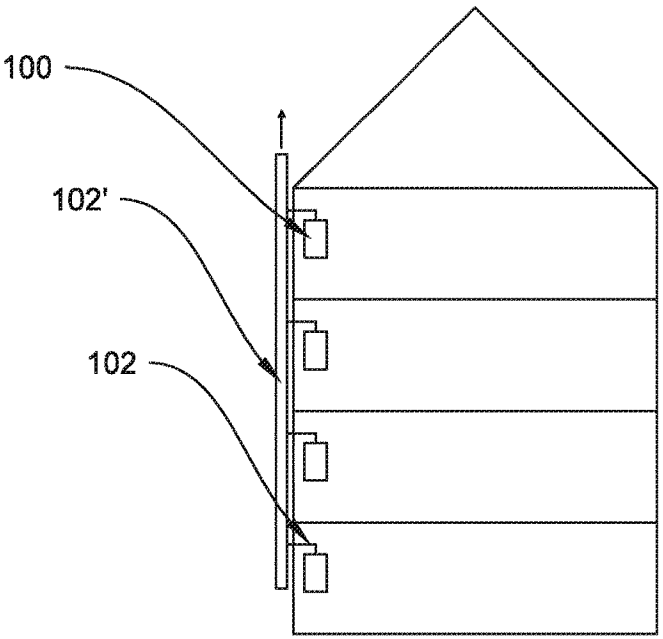
Figure 7:
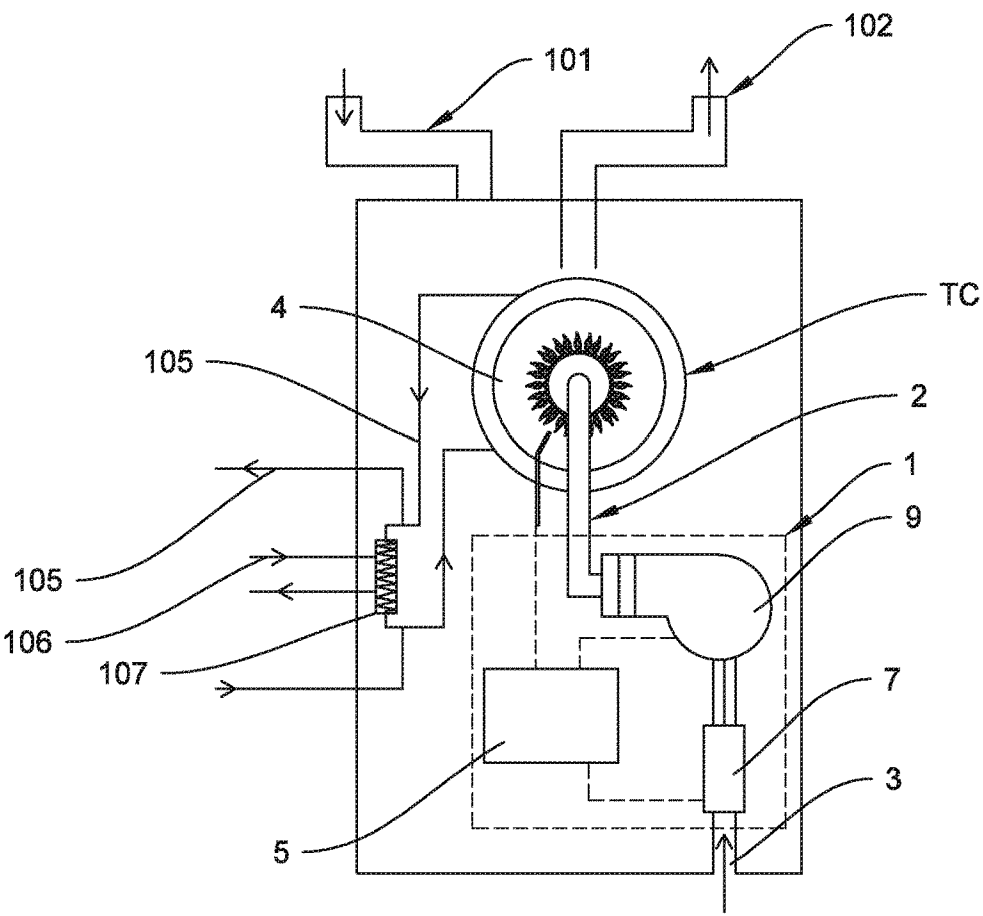
Figure 8B:
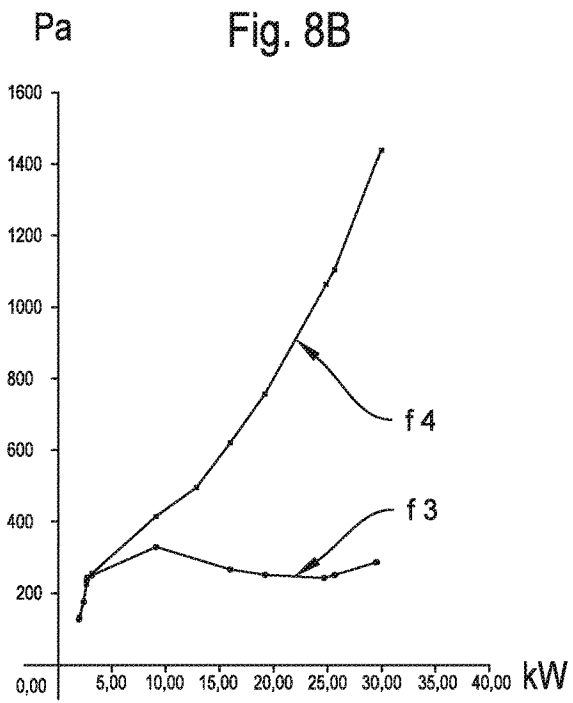
Figure 8C:
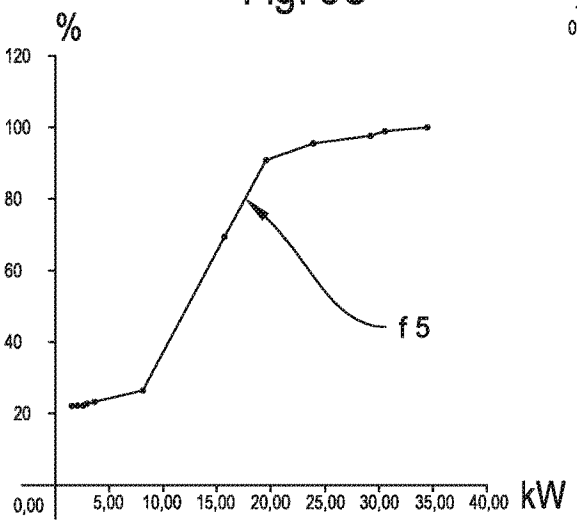
Figure 8A:
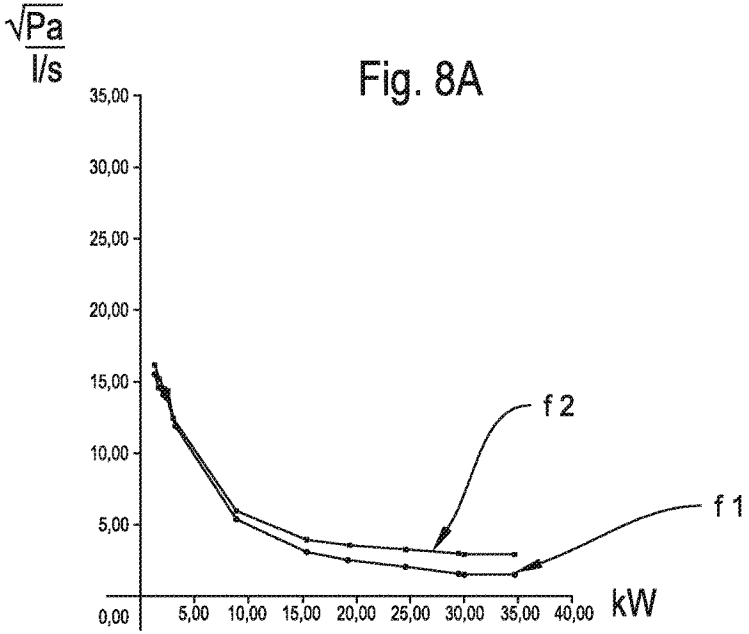

FIGS. 4A, 4B and 4C schematically illustrate three operating configurations of the regulator of FIG. 2A;

FIG. 5 illustrates an embodiment of the regulator of FIG. 2A;

FIGS. 6A and 6B represent, respectively, a trend of a first and a second working cross section as a function of the flow rate of oxidizer and a trend of the working pressure as a function of the flow rate of oxidizer;

FIG. 6C shows a graph comparing a first curve c1, which describes the working pressure as a function of the flow rate of oxidizer for the control device of FIG. 1, with a second curve c2, which describes the working pressure as a function of the flow rate of oxidizer for a prior art control device;

FIG. 7 schematically illustrates a burner;

FIG. 7A schematically illustrates a variant of a domestic installation of a plurality of burners;

FIG. 8A shows a graph comparing a first function f1, representing a trend of a fluid resistance of the regulator as a function of the thermal power, with a second function f2, representing a trend of the total fluid resistance of the control device as a function of the thermal flow;

FIG. 8B shows a graph comparing a third function f3, representing a trend of a pressure loss due to the regulator as a function of the thermal power, with a fourth function f4, representing a trend of pressure loss due to the control device as a function of the thermal flow;

FIG. 8C shows a graph f5, representing a trend of a percentage of open working cross section compared to the total working cross section as a function of the thermal flow.

With reference to the accompanying drawings, the numeral 1 denotes a device for controlling the fuel-oxidizer mixture in premix gas burners 100.

The device comprises an intake duct 2 which defines a cross section S through which a fluid is admitted into the duct. The intake duct 2 may be circular or rectangular in cross section. The intake duct 2 extends from (includes) an inlet 201, configured to receive the oxidizer, to (and) a delivery outlet 203, configured to supply the mixture to the burner 100. The intake duct 2 includes a mixing zone 202 for receiving the fuel and allowing it to be mixed with the oxidizer.

The device 1 comprises an injection duct 3. The injection duct 3 is connected, at a first end of it 301, to the intake duct 2 in the mixing zone 202, to supply the fuel. The injection duct 3 is connected, at a second end of it, to a gas supply such as, for example, a gas cylinder or the national gas grid.

The device 1 comprises a monitoring device 4. The monitoring device is configured to generate a control signal 401. In an embodiment, the control signal 401 represents a state of combustion in the burner 100. The monitoring device comprises a flame sensor, mounted in a combustion head TC of the burner 100, to monitor the state of combustion. In other embodiments, the monitoring device 4 comprises a thermal sensor and/or a pressure sensor and/or a flow sensor. In these embodiments, the control signals 401 represent a physical parameter that the respective sensor is configured to detect.

The monitoring device 4 is configured to send the control signals 401 discretely at a predetermined detection frequency. In an embodiment, the monitoring device 4 is configured to send the control signals 401 continuously.

The device 1 comprises a gas regulating valve 7. The gas regulating valve 7 is located along the injection duct 3. In an embodiment, the gas regulating valve 7 is electronically controlled. The gas regulating valve 7 comprises a solenoid valve. The gas regulating valve 7 is configured to vary a cross section of the injection duct 3 as a function of the control signals 401.

The device 1 comprises a fan 9. The fan 9 rotates at a variable rotation speed v. The fan 9 is located in the intake duct 2 to generate therein a flow of oxidizer in a direction of inflow V oriented from the inlet 201 to the delivery outlet 203.

The device 1 comprises a control unit 5. The control unit 5 is configured to control the speed of rotation v of the fan 9 between a first rotation speed, corresponding to a minimum flow rate of oxidizer Qmin, and a second rotation speed, corresponding to a maximum flow rate of oxidizer Qmax.

The control unit 5 is configured to receive the control signals 401 and to generate drive signals 501 as a function of the control signals 401. The drive signals 501 represent a rotation speed v of the fan 9.

In an embodiment, the device 1 comprises a user interface 50, configured to allow a user to enter configuration data. The configuration data are data that represent working parameters of the device 1 such as, for example, temperature of the fluid heated by the burner, pressure of the fluid in the burner, flow rate.

In an embodiment, the control unit 5 is configured to receive configuration signals 500', representing the configuration data, and to generate the drive signal 501 as a function of the configuration signals 500'.

In an embodiment, the device 1 comprises a regulator 8. In an embodiment, the regulator 8 is configured to vary the flow rate of oxidizer flowing through the intake duct 2. In an embodiment, the regulator 8 is configured to prevent fluid from flowing in a return direction, opposite to the direction of inflow V.

In an embodiment, the regulator comprises at least one partializing valve. By partializing valve is meant a valve capable of varying its operating configuration as a function of the rotation speed v of the fan 9, that is, of the flow rate of oxidizer.

In an embodiment, the regulator comprises at least two partializing valves. In an embodiment, one partializing valve is configured to vary its position in a working range different from that of the other partializing valve.

In an embodiment, the regulator 8 has a flat shape. This flat shape may take different forms, configured to be correctly connected to the intake duct 2. Preferably, the regulator 8 has the shape of a disc.

In an embodiment, the regulator 8 comprises a wall 81. The wall 81 is perpendicular to the direction of flow of the oxidizer. In an embodiment, the wall 81 comprises a first aperture 811. In an embodiment, the wall 81 comprises a second aperture 812. The flow cross section of the first aperture 811 and/or of the second aperture 812 is cylindrical or rectangular in shape.

In an embodiment, the wall 81 comprises a first plurality of holes 813, each configured to receive a respective connector to fasten the wall to the intake duct 2.

In an embodiment, the thickness of the wall 81 at the first plurality of holes 813 is greater than the thickness of the wall in the other portions of the wall 81.

In an embodiment, the wall 81 comprises a first mouth 811'. In an embodiment, the wall 81 comprises a second mouth 812'. The first mouth 811' is located upstream of the first aperture 811 in the direction of inflow V.

The second mouth 812' is located upstream of the second aperture 812 in the direction of inflow V.

The first mouth 811' is configured to convey the oxidizer into the first aperture 811. The second mouth 812' is configured to convey the oxidizer into the second aperture 812.

The first mouth 811' is configured to accelerate the flow of oxidizer into the first aperture 811. The second mouth 812' is configured to accelerate the flow of oxidizer into the second aperture 812.

In an embodiment, the first mouth 811' and the second mouth 812' each comprise a first side wall 811A, 812A and a second side wall 811B, 812B, converging towards each other in the direction of inflow V.

In an embodiment, the first side wall 811A and the second side wall 811B of the first mouth 811 are more convergent than the first side wall 812A and the second side wall 812B of the second mouth 812.

In an embodiment, the regulator 8 comprises a plastic element (shutter portion) 82. The term "plastic" refers to this specific embodiment but should in no way be construed as limiting the scope of protection afforded by this document to a shutter portion made solely of plastic material. A person skilled in the trade reading this document could easily identify other embodiments to obtain the same effect as that described in this disclosure.

The plastic element 82 surrounds the wall 81. The plastic element is configured to be deformed and to create a fluid seal in the regulator.

In an embodiment, the plastic element 82 surrounds the entire periphery of the wall 81. The plastic element comprises a second plurality of holes 823, aligned with the first plurality of holes 813 along a direction of inflow, to allow receiving the connectors which connect the regulator 8 to the intake duct 2.

In an embodiment, the plastic element 82 has the shape of a circular crown. The plastic element 82 comprises a coupling groove 82'. The coupling groove 82' is configured to receive an outer circular crown of the wall 81.

In an embodiment, the plastic element 82 comprises a first shutter 821. In an embodiment, the plastic element 82 comprises a second shutter 822.

The first shutter 821 is movable from a closed position P1, where the first aperture 811 is fully closed by the shutter 821, to an open position P2, where the first aperture 811 is at least partly open.

The second shutter 822 is movable from a closed position P3, where the second aperture 812 is fully closed by the shutter 822, to an open position P4, where the second aperture 812 is at least partly open.

The second shutter 822 is connected to the circular crown of the plastic element 82. The second shutter 822 rotates relative to the circular crown of the plastic element 82. In an embodiment, the second shutter 822 is connected to the plastic element 82 by a connecting portion 822' which is more flexible than the other portions of the second shutter 822. In an embodiment, the first shutter 821 is connected to the second shutter 822. In an embodiment, the first shutter 821 is connected to the circular crown of the plastic element 82.

In an embodiment, the first shutter 821 is connected to the plastic element 82 by a connecting portion 821' which is more flexible than the other portions of the first shutter 821. In an embodiment, the first shutter 821 is connected to the second shutter 822 by the connecting portion 821'. The first shutter 821 rotates relative to the circular crown of the plastic element 82 and/or relative to the second shutter 822.

In other embodiments, instead of the respective connecting portions 821' and 822', the first shutter 821 and the second shutter 822 are connected to the circular crown of the plastic element 82 by a corresponding first and second hinge, which allow rotation.

In other embodiments, instead of the connecting portions 821', the first shutter 821 is connected to the second shutter 822 by the first hinge.

In an embodiment, the first shutter 821 is a solid having a mass M1 and resting on the wall 81 under the effect of its own weight F1. In an embodiment, the second shutter 822 is a solid (in an embodiment, the solid is hollow) having a mass M2 and resting on the wall 81 under the effect of its own weight F2. In an embodiment, the second shutter 822 comprises a cavity 822A. In an embodiment, the first shutter 821 and the second shutter 822 comprise a first and a second door.

In an embodiment, the second shutter 822 comprises a calibration element 822B, configured to be housed in the cavity 822A to modify the mass M2 of the second shutter. In an embodiment, the calibration element 822B may be replaced with another calibration element 822B having a different mass.

In an embodiment, the mass M1 is less than the mass M2 according to a ratio of at least 1:5 or 1:10 or 1:20.

In an embodiment, the first shutter 821 comprises a first plurality of contact elements 821", disposed between the wall 81 and the first shutter 821.

In an embodiment, the second shutter 822 comprises a second plurality of contact elements 822", disposed between the wall 81 and the second shutter 822.

In an embodiment, the regulator 8 comprises a first operating configuration C1. In the first operating configuration C1, the first shutter 821 is at the closed position P1. In the first operating configuration C1, the second shutter 822 is at the closed position P3. The first operating configuration C1 corresponds to fan rotation speeds lower than the first rotation speed v1. The first operating configuration C1 corresponds to oxidizer flow rates Q less than or equal to the minimum flow rate Qmin of the oxidizer.

In an embodiment, the regulator 8 comprises a second operating configuration C2. In the second operating configuration C2, the first shutter 821 is at the open position P2. In the second operating configuration C2, the second shutter 822 is at the closed position P3. The second operating configuration C2 corresponds to fan rotation speeds in a first working range, between the first rotation speed and a cut-out speed, higher than the first rotation speed and lower than the second rotation speed. The second operating configuration C2 corresponds to oxidizer flow rates in the first working range, between the minimum flow rate Qmin of the oxidizer and a cut-out flow rate Qst of the oxidizer, corresponding to the cut-out speed.

In an embodiment, the regulator 8 comprises a third operating configuration C3. In the third operating configuration C3, the first shutter 821 is at the open position. In the third operating configuration C3, the second shutter 822 is at the open position P4. The third operating configuration C3 corresponds to fan rotation speeds in a second working range, between the cut-out speed and the second rotation speed. The third operating configuration C3 corresponds to oxidizer flow rates in the second working range, between the cut-out flow rate Qst of the oxidizer and the maximum flow rate Qmax of the oxidizer.

In an embodiment, the first shutter 821 and the second shutter 822 are movable under the effect of a pressure difference due to the fan 9.

More specifically, the fan 9 rotating at a rotation speed is configured to increase the oxidizer flow rate, increasing the load losses through the regulator 8. The increase in the load losses determines a pressure on the first shutter 821 which displaces the first shutter. The same operating principle applies to the second shutter 822.

Thus, in an embodiment in which the first shutter 821 is at the closed position under the effect of gravity, the first shutter 821 is configured to start moving the moment the pressure difference due to the flow of oxidizer exceeds the holding pressure due to the weight P1 of the first shutter 821 discharged onto the surface of the first shutter 821. The same operating principle applies to the second shutter 822.

In a variant of the device, the regulator 8 comprises a first spring 84 and a second spring 85, connected to the first shutter 821 and to the second shutter 822, respectively. The first spring 84 and the second spring 85 are configured to exert an elastic force in a direction opposite to the opening direction of the first shutter 821 and second shutter 822, respectively. In this embodiment, the first shutter 821 and the second shutter 822 are each configured to start moving the moment the pressure difference due to the flow of oxidizer exceeds the elastic force of the first spring 84 and of the second spring 85, respectively. In this embodiment, the elastic constant of the first spring 84 is lower than the elastic constant of the second spring 85 (in a ratio of at least 1:5 or 1:10 or 1:20 or 1:30).

In a further variant of the device, the first shutter 821 is electronically controlled. In this embodiment, the control unit 5 is connected to the first shutter 821 to send it the drive signal 501. More specifically, in some embodiments, the first shutter 821 comprises a "fail safe" valve, that is, a valve configured to be opened only when electrically (electronically) powered. In this embodiment, the control unit 5 is configured to feed the first shutter 821 the moment the burner is switched on and before the fan 9 starts rotating so that the shutter moves to the open position P2. The moment the burner 100 is switched off, the control unit is configured to stop feeding the first shutter 821, which thus moves to the closed position P1.

In an embodiment, the second shutter is also electronically controlled.

With reference to FIGS. 6A and 6B, the terms used have the following meanings:

Qmax: maximum flow rate of oxidizer, corresponding to the second rotation speed of the fan 9;

Qmin: minimum flow rate of oxidizer, corresponding to the first rotation speed of the fan 9;

Qst: cut-out flow rate, corresponding to the cut-out rotation speed of the fan 9;

S1max: maximum value of the first working cross section S1;

S2max: maximum value of the second working cross section S2;

pmax: maximum lift pressure, corresponding to the maximum flow rate of oxidizer;

pm1: holding pressure of the first shutter 821, corresponding to the fan rotation speed at which the first shutter 821 is lifted;

pm2: holding pressure of the second shutter 822, corresponding to the cut-out flow rate;

pmin: minimum lift pressure, corresponding to the minimum flow rate of oxidizer.

According to one aspect of it, this disclosure provides a heat generator 100. The heat generator comprises a combustion head TC. The combustion head TC is configured to burn a fuel-oxidizer mixture which is fed into it. The combustion head TC comprises an ignition device, configured to allow igniting the mixture, and/or a monitoring device 4, configured to detect a state of combustion in the combustion head TC.

In an embodiment, the heat generator 100 comprises an air feed duct 101, through which atmospheric air—that is, the oxidizer for the generator—flows in. In an embodiment, the generator 100 comprises an exhaust duct 102 configured to convey the combustion exhaust gases to the outside. In other embodiments, the exhaust duct 102 is configured to convey the exhaust gases into an exhaust manifold 102', which collects the exhaust gases from different generators installed in a single building.

In an embodiment, the generator comprises a control device 1 according to one or more of the features described in this disclosure.

In an embodiment, the generator comprises an intake duct 2 configured to convey a fuel-oxidizer mixture into the combustion head TC.

In an embodiment, the generator comprises a control unit 5. In an embodiment, the generator comprises a fan 9, configured to generate a flow of oxidizer and/or of fuel-oxidizer mixture into the intake duct 2. In an embodiment, the generator comprises an injection duct 3 and a gas regulating valve 7 which is mounted on the injection duct to regulate the injected gas flow rate. The injection duct 3 is open onto the intake duct 2 in a mixing zone 202, where the oxidizer (air) and the fuel (gas) are mixed together.

In an embodiment, the generator comprises a regulator 8, configured to vary the cross section of the intake duct 2 as a function of the speed of rotation of the fan 9.

In an embodiment, the heat generator 100 comprises a first heating circuit 105. The first heating circuit 105 is positioned at least partly inside the combustion head TC to draw heat therefrom. In an embodiment, the first heating circuit 105 extends to the outside of the heat generator 100. More specifically, in some embodiments, the first heating circuit 105 is connected to a water heating system to heat buildings.

In an embodiment, the heat generator 100 comprises a second heating circuit 106. In an embodiment, the heat generator 100 comprises a heat exchanger 107. The second heating circuit 106 extends to the outside of the heat generator 100. In some embodiments, the second heating circuit 106 is integrated in domestic utility installations, which require a high level of water hygiene.

In an embodiment, the second heating circuit 106 and the first heating circuit 105 pass through the exchanger 107 to exchange heat with each other.

It should be noted that the regulator 8 may comprise one or more of the features described in this disclosure.

According to one aspect of it, this disclosure also provides a method for controlling the fuel-oxidizer mixture in premix gas burners.

The method comprises a step of admitting oxidizer into an intake duct 2 through an inlet 201. The method comprises a step of delivering fuel-oxidizer mixture through a delivery outlet 203. The method comprises a step of mixing oxidizer and fuel in a mixing zone 202. The method comprises a step of feeding fuel to the mixing zone 202 through an injection duct 3 connected to the intake duct 2.

The method comprises a step of monitoring the combustion in the burner 100 and generating control signals 401 through a monitoring device 4. More specifically, the monitoring device 4 detects a value of a physical quantity such as, for example, temperature, pressure, brightness, and converts this value into a control signal representing the value of that physical quantity.

In an embodiment, the method comprises a step of generating a drive signal 501 through a control unit 5. The step of generating the drive signals 501 is performed as a function of the control signals 401.

In an embodiment, the method comprises a step of sending the drive signals 501 to one or more components of the control device 1 of the mixture.

The method comprises a step of varying a fuel flow rate through a gas regulating valve 7 located along the injection duct 3.

The method comprises a step of operating a fan 9 at a variable speed of rotation v. The method comprises a step of generating a flow in the intake duct 2 in a direction of inflow V oriented from the inlet 201 to the delivery outlet 203. As it rotates, the fan 9 transmits a thrust to the oxidizer, depending on the drive torque provided by an actuator which drives the fan 9. The flow rate of the oxidizer is proportional to the rotation speed v of the fan 9.

In an embodiment of the method, the fan 9 varies its speed of rotation in a working range between a first rotation speed, corresponding to a minimum flow rate of oxidizer Qmin, and a second rotation speed, corresponding to a maximum flow rate of oxidizer Qmax.

In an embodiment, the method comprises a step of varying a cross section S which admits a fluid into the intake duct 2. In an embodiment, the cross section S of the intake duct 2 varies as a function of the rotation speed of the fan. The step of varying a cross section S is performed by a regulator 8 coupled to the intake duct 2.

In an embodiment, in the step of varying the fuel flow rate, the control unit 5 receives the control signal 401 and generates the drive signal 501 representing a fuel flow rate as a function of the control signal 401 in order to drive the gas regulating valve 7 in real time. In an embodiment, the drive signal 501 also represents a flow rate of the oxidizer to drive the fan 9 in real time. The control unit 5 sends the drive signal 501 to the fan to vary its rotation speed.

In an embodiment, the step of varying the cross section S of the intake duct 2 comprises a step of moving a first shutter 821 of the regulator 8 between a closed position P1, where a first aperture 811 is fully closed, and an open position P2, where the first aperture 811 is at least partly open, to vary a first working cross section S1 of the first aperture 811 of the regulator 8.

In an embodiment, the step of varying the cross section S of the intake duct 2 comprises a step of moving a second shutter 822 of the regulator 8 between a closed position P3, where a second aperture 812 is fully closed, and an open position P4, where the second aperture 812 is at least partly open, to vary a second working cross section S2 of the second aperture 812 of the regulator 8.

The flow of oxidizer produced by the fan 9 generates a lifting pressure on the first shutter 821 and on the second shutter 822, due to the difference in pressure upstream and downstream of the respective shutter 821, 822 caused by the load losses.

In the step of varying the cross section S, the first shutter 821 remains at the closed position P1 for rotation speeds of the fan 9 lower than the first rotation speed. In the step of varying the cross section S, the second shutter 822 remains at the closed position P3 for rotation speeds of the fan 9 lower than the first rotation speed.

More specifically, in the step of varying the cross section S, the fan 9 produces a minimum flow of oxidizer when it rotates at the first rotation speed. This minimum flow of oxidizer generates a minimum lifting pressure on the first and second shutter 821 and 822, directed along the direction of inflow V. In an embodiment, the first shutter 821 and the second shutter 822 are subjected to a holding pressure. The holding pressure can be generated in different ways. Preferably, the holding pressure is due to the weight of each of the first and second shutters 821 and 822 and/or to the surface of the aperture of the first and the second shutter 821 and 822. In other embodiments, the holding pressure can be regulated by inserting an elastic element configured to exert an elastic force in a direction opposite to an opening direction (direction in which a movement of the first shutter 821 and of the second shutter 822 corresponds to an increment of the first working cross section S1 and of the second working cross section S2) of the first shutter 821 and of the second shutter 822.

The holding pressure is clearly determined both by the weight and by the surface of the first and the second shutter 821 and 822 on which the weight is applied.

The minimum lifting pressure is greater than or equal to the holding pressure of the first shutter 821. The minimum lifting pressure is less than the holding pressure of the second shutter 822. Therefore, when the first shutter 821 starts being lifted, the second shutter 822 remains at the closed position P3.

In the step of varying the cross section S, the first shutter 821 remains at the open position P2 for rotation speeds of the fan 9 greater than or equal to the first rotation speed. In the step of varying the cross section S, the second shutter 822 remains at the closed position P3 for rotation speeds of the fan 9 between the first rotation speed and a cut-out speed (the rotation speed of the fan at which the lifting pressure equals the holding pressure of the second shutter 822). More specifically, in the step of varying the cross section S, the fan 9 produces a cut-out flow when it rotates at the cut-out speed. This cut-out flow generates a cut-out (lifting) pressure on the first and second shutter 821 and 822, directed along the direction of inflow V.

The cut-out pressure is greater than the holding pressure of the first shutter 821. The cut-out pressure is equal to the holding pressure of the second shutter 822. Therefore, when the second shutter 822 starts being lifted, the first shutter 821 is at the open position P2.

In the step of varying S, the second shutter 822 continues moving (to partialize the oxidizer—to vary the second working cross section S2) for rotation speeds of the fan 9 between the cut-out speed and the second rotation speed. More specifically, in the step of varying the cross section S, the fan 9 produces a maximum flow of oxidizer when the fan 9 rotates at the second rotation speed. This maximum flow of oxidizer generates a maximum lifting pressure on the first and second shutter 821 and 822, directed along the direction of inflow V.

The maximum lifting pressure is greater than the holding pressure of the first shutter 821. The maximum lifting pressure is greater than the holding pressure of the second shutter 822. At the maximum lifting pressure, therefore, the first shutter 821 is at the open position P2 and the second shutter 822 is at the open position P4.

In light of the method described, therefore, the first shutter 821 is configured to perform the function of non-return valve, that is, to be closed when outside the working range of the burner and to be opened when the burner 100 is ignited, while the second shutter 822 is configured to partialize the oxidizer in use, considerably reducing the maximum working pressure reached by the fan 9.

In an embodiment, the method comprises a step of adjusting. The step of adjusting allows varying design parameters such as, for example, the cut-out speed of the second shutter 822, by modifying the physical properties of the second shutter.

More specifically, the step of adjusting comprises a step of providing a calibration element 822B inside a cavity 822A of the second shutter. The calibration element 822B provides a series of adjustment parameters such as, for example, but not only, the density of the calibration element 822B, the rigidity of the calibration element 822B, the volume of the calibration element 8228.

The holding pressure of the second shutter 822 therefore depends on the calibration element 822B.

In an embodiment, the step of adjusting comprises a step of replacing. In the step of replacing, the first calibration element 822B is replaced with a second calibration element whose physical properties differ from those of the first calibration element 8228.

In an embodiment, the step of moving the first shutter 821 comprises rotating about a first pivot 821'. In an embodiment, the step of moving the second shutter 822 comprises rotating about a second pivot 822'. In an embodiment, the first pivot 821' connects the first shutter 821 and the second shutter 822.

In an embodiment, the method comprises a step of opposing. In the step of opposing, an opposing element comes into abutment against the first shutter 821 when it is at the open position P2 to ensure that it does not remain blocked at the open position P2 when the burner 100 is switched off. In an embodiment, the opposing element is configured to exert a force directed opposite to the opening direction of the first shutter 821 to keep the first shutter 821 at the closed position P1 when the burner 100 is switched off.

In an embodiment, the method comprises a step of conveying.

The step of conveying comprises a first step of conveying in which a first mouth 811' conveys the oxidizer into the first aperture 811. In the first step of conveying, the first mouth 811' accelerates the flow of oxidizer into the first aperture 811.

The step of conveying comprises a second step of conveying in which a second mouth 812' conveys the oxidizer into the second aperture 812. In the second step of conveying, the second mouth 812' accelerates the flow of oxidizer into the second aperture 812.

In an embodiment, in the step of conveying, the oxidizer is accelerated more towards the first aperture 811 than towards the second aperture 812 in order to facilitate opening the first shutter 821 The different acceleration is due to the greater convergence of the first mouth 811' compared to the second mouth 812'.

In an embodiment, the method comprises a step of sealing in which the first shutter 821 creates a fluid seal on the first aperture 811 to prevent fluid from returning in a direction opposite to the direction of inflow V.

In the step of sealing, the second shutter 822 creates a fluid seal on the second aperture 812 to prevent fluid from returning in a direction opposite to the direction of inflow V.

The invention claimed is:

1. A device for controlling a fuel-oxidizer mixture for a premix gas burner, comprising:

an intake duct, which defines a cross section for the admission of a fluid into the duct, and comprises an inlet for receiving the oxidizer, a mixing zone for receiving the fuel and allowing it to be mixed with the oxidizer, and an outlet for delivering the mixture to the burner;

an injection duct, connected to the intake duct in the mixing zone to supply the fuel;

a monitoring device that generates a control signal representing a state of combustion in the burner;

a gas regulating valve, located along the injection duct;

a fan, rotating at a variable rotation speed and located in the intake duct to generate therein a flow of oxidizer in a direction of inflow oriented from the inlet to the delivery outlet;

a control unit that controls a speed of rotation of the fan between a first rotation speed, corresponding to a minimum flow rate of oxidizer (Qmin), and a second rotation speed, corresponding to a maximum flow rate of oxidizer (Qmax); and a regulator coupled to the intake duct to vary the cross section of the intake duct as a function of the speed of rotation of the fan, the regulator comprising:

a first aperture, for defining a first working cross section;

a first shutter, movable under an effect of a pressure difference created in the intake duct by the rotation of the fan between a closed position, where the first aperture is fully closed, and an open position, where the first aperture is at least partly open, to vary the first working cross section;

a second aperture defining a second working cross section; and a second shutter, movable under an effect of a pressure difference created in the intake duct by the rotation of the fan, between a closed position, where the second aperture is fully closed, and an open position, where the second aperture is at least partly open, to vary the second working cross section as a function of the rotation speed of the fan;

wherein the control unit receives the control signal and generates a drive signal representing a fuel flow rate as a function of the control signal to drive the gas regulating valve in real time, wherein the first shutter is positioned at the open position when the rotation speed of the fan is higher than the first rotation speed.

2. The device according to claim 1, wherein the first shutter, at the open position, is disposed at a limit position so that the open position of the first shutter corresponds to a maximum value (S1max) obtainable by the first shutter for the first working cross section.

3. The device according to claim 2, wherein the second shutter is positioned at the closed position when the rotation speed of the fan is lower than a cut-out speed, which is greater than the first rotation speed and less than the second rotation speed.

4. The device according to claim 3, wherein the first shutter is connected to the second shutter.

5. The device according to claim 3, wherein the first shutter is smaller in mass than the second shutter by a ratio of at least 1:3.

6. The device according to claim 5, wherein the second shutter comprises a socket and a first calibrating element housed in the socket, the first calibrating element being replaceable with a second calibrating element, differing in mass from the first calibrating element, to vary the cut-out speed.

7. The device according to claim 1, wherein the first shutter comprises a first door, positioned downstream of the first aperture in the direction of inflow and rotating about a first pivot to move from the closed position to the open position, and wherein the second shutter comprises a second door, positioned downstream of the second aperture in the direction of inflow and rotating about a second pivot.

8. The device according to claim 7, wherein the first pivot is defined by a portion of the first door that is more flexible than other portions of the first door.

9. The device according to claim 1, wherein the regulator comprises an opposing element, connected to the first shutter, that generates a force in a direction opposite to an opening direction of the first shutter to promote closure of the first shutter when the rotation speed of the fan is lower than the first rotation speed.

10. The device according to claim 1, wherein the regulator is disc-shaped and comprises a wall, which is perpendicular to a direction of oxidizer flow and on which the first aperture and the second aperture are made, and a plastic element which is coupled to the wall and which includes the first shutter and the second shutter, and wherein the wall includes a hooking zone configured to be connected to a delivery outlet of the fan.

11. The device according to claim 1, wherein the regulator comprises a first mouth and a second mouth, located upstream of the first aperture and of the second aperture, respectively, in the direction of inflow, to convey the flow of oxidizer into the respective apertures, wherein the profiles of the first mouth and of the second mouth are convergent in the direction of inflow, and wherein a convergence of the first mouth is greater than a convergence of the second mouth to accelerate the oxidizer directed towards the first aperture.

12. The device according to claim 1, wherein the first shutter and the first aperture interfere with discharge flow return, and wherein the second shutter and the second aperture are configured to partialize a flow of oxidizer or mixture directed towards a combustion head, so that the device partializes the flow of oxidizer or fuel-oxidizer mixture and, at the same time, forms a non-return valve.

13. A method for controlling the fuel-oxidizer mixture in a premix gas burner, comprising:

admitting oxidizer into an intake duct through an inlet;

delivering fuel-oxidizer mixture through a delivery outlet;

mixing oxidizer and fuel in a mixing zone;

feeding fuel to the mixing zone through an injection duct connected to the intake duct;

monitoring the combustion in the burner and generating control signals through a monitoring device;

generating a drive signal through a control unit as a function of the control signals;

varying a fuel flow rate through a gas regulating valve located along the injection duct;

operating a fan at a variable speed of rotation and generating a flow in the intake duct in a direction of inflow oriented from the inlet to the delivery outlet, the fan varying its rotation speed in a working interval comprised between a first rotation speed, corresponding to a minimum oxidizer flow rate (Qmin), and a second rotation speed, corresponding to a maximum oxidizer flow rate (Qmax);

varying a cross section which admits a fluid into the intake duct as a function of the fan rotation speed through a regulator coupled to the intake duct; wherein varying the cross section comprises:

moving a first shutter of the regulator between a closed position, where a first aperture of the regulator is fully closed, and an open position, where the first aperture is at least partly open, to vary a first working cross section of the first aperture of the regulator;

moving a second shutter of the regulator, which is movable to vary a second working cross section of a second aperture of the regulator as a function of the rotation speed of the fan, wherein varying the fuel flow rate comprises, receiving with the control unit, the control signal and generating the drive signal representing a fuel flow rate as a function of the control signal in order to drive the gas regulating valve in real time, wherein the first shutter is at the open position when the rotation speed of the fan is higher than the first rotation speed.

14. The method according to claim 13, wherein the second shutter is at the closed position when the rotation speed of the fan is lower than a cut-out speed, which is higher than the first rotation speed and lower than the second rotation speed.

15. A device for controlling a fuel-oxidizer mixture for a premix gas burner, comprising:

an intake duct, which defines a cross section for the admission of a fluid into the duct, and comprises an inlet for receiving the oxidizer, a mixing zone for receiving the fuel and allowing it to be mixed with the oxidizer, and an outlet for delivering the mixture to the burner;

an injection duct, connected to the intake duct in the mixing zone to supply the fuel;

a monitoring device that generates a control signal representing a state of combustion in the burner;

a gas regulating valve, located along the injection duct;

a fan, rotating at a variable rotation speed and located in the intake duct to generate therein a flow of oxidizer in a direction of inflow oriented from the inlet to the delivery outlet;

a control unit that controls a speed of rotation of the fan between a first rotation speed, corresponding to a minimum flow rate of oxidizer (Qmin), and a second rotation speed, corresponding to a maximum flow rate of oxidizer (Qmax); and a regulator coupled to the intake duct to vary the cross section of the intake duct as a function of the speed of rotation of the fan, the regulator comprising:

a first aperture, for defining a first working cross section;

a first shutter, movable under an effect of a pressure difference created in the intake duct by the rotation of the fan between a closed position, where the first aperture is fully closed, and an open position, where the first aperture is at least partly open, to vary the first working cross section;

a second aperture defining a second working cross section; and a second shutter, movable under an effect of a pressure difference created in the intake duct by the rotation of the fan, between a closed position, where the second aperture is fully closed, and an open position, where the second aperture is at least partly open, to vary the second working cross section as a function of the rotation speed of the fan;

wherein the control unit receives the control signal and generates a drive signal representing a fuel flow rate as a function of the control signal to drive the gas regulating valve in real time, wherein the first shutter comprises a first door, positioned downstream of the first aperture in the direction of inflow and rotating about a first pivot to move from the closed position to the open position, and wherein the second shutter comprises a second door, positioned downstream of the second aperture in the direction of inflow and rotating about a second pivot.

16. A device for controlling a fuel-oxidizer mixture for a premix gas burner, comprising:

an intake duct, which defines a cross section for the admission of a fluid into the duct, and comprises an inlet for receiving the oxidizer, a mixing zone for receiving the fuel and allowing it to be mixed with the oxidizer, and an outlet for delivering the mixture to the burner;

an injection duct, connected to the intake duct in the mixing zone to supply the fuel;

a monitoring device that generates a control signal representing a state of combustion in the burner;

a gas regulating valve, located along the injection duct;

a fan, rotating at a variable rotation speed and located in the intake duct to generate therein a flow of oxidizer in a direction of inflow oriented from the inlet to the delivery outlet;

a control unit that controls a speed of rotation of the fan between a first rotation speed, corresponding to a minimum flow rate of oxidizer (Qmin), and a second rotation speed, corresponding to a maximum flow rate of oxidizer (Qmax); and a regulator coupled to the intake duct to vary the cross section of the intake duct as a function of the speed of rotation of the fan, the regulator comprising:

a first aperture, for defining a first working cross section;

a first shutter, movable under an effect of a pressure difference created in the intake duct by the rotation of the fan between a closed position, where the first aperture is fully closed, and an open position, where the first aperture is at least partly open, to vary the first working cross section;

a second aperture defining a second working cross section; and a second shutter, movable under an effect of a pressure difference created in the intake duct by the rotation of the fan, between a closed position, where the second aperture is fully closed, and an open position, where the second aperture is at least partly open, to vary the second working cross section as a function of the rotation speed of the fan;

wherein the control unit receives the control signal and generates a drive signal representing a fuel flow rate as a function of the control signal to drive the gas regulating valve in real time, wherein the regulator comprises a wall, which is perpendicular to the fluid oxidizer, the first and the second apertures being formed in the wall.

* * * * *